US007021294B2

(12) United States Patent
Yamamoto et al.

(10) Patent No.: US 7,021,294 B2
(45) **Date of Patent: *Apr. 4, 2006**

(54) FUEL PUMP CONTROL DEVICE

(75) Inventors: Takao Yamamoto, Saitama (JP); Ryota Umetani, Saitama (JP); Yoshihiko Tsuchiya, Saitama (JP); Kenichi Nishizawa, Saitama (JP)

(73) Assignee: Exelixis, Inc., S. San Francisco, CA (US)

( * ) Notice: Subject to any disclaimer, the term of this patent is extended or adjusted under 35 U.S.C. 154(b) by 34 days.

This patent is subject to a terminal disclaimer.

(21) Appl. No.: 10/417,121

(22) Filed: Apr. 17, 2003

(65) Prior Publication Data

US 2003/0188719 A1 Oct. 9, 2003

Related U.S. Application Data

(62) Division of application No. 09/456,477, filed on Dec. 7, 1999, now Pat. No. 6,553,972.

(30) Foreign Application Priority Data

Dec. 7, 1998 (JP) ..... 10-346358

(51) Int. Cl.
*F02M 37/04* (2006.01)

(52) U.S. Cl. ..... 123/497; 123/456

(58) Field of Classification Search ..... 123/497, 123/456, 357, 499, 198 D
See application file for complete search history.

(56) References Cited

U.S. PATENT DOCUMENTS

| | | | | |
|---|---|---|---|---|
| 4,554,634 A | | 11/1985 | Shinoda | |
| 4,756,291 A | | 7/1988 | Cummins et al. | |
| 4,800,859 A | * | 1/1989 | Sagisaka et al. | 123/497 |
| 4,919,102 A | * | 4/1990 | Iwabuchi | 123/499 |
| 4,932,387 A | * | 6/1990 | Flam et al. | 123/607 |
| 5,092,302 A | * | 3/1992 | Mohan | 123/497 |
| 5,293,299 A | * | 3/1994 | Iwabuchi et al. | 361/152 |
| 5,313,923 A | * | 5/1994 | Takeuchi et al. | 123/497 |
| 5,502,963 A | | 4/1996 | Inaba | |
| 5,555,872 A | * | 9/1996 | Takeuchi et al. | 123/497 |
| 5,579,738 A | * | 12/1996 | Frischmuth et al. | 123/497 |
| 5,752,490 A | * | 5/1998 | Rodgers et al. | 123/497 |
| 5,937,829 A | * | 8/1999 | Endou | 123/497 |
| 6,053,147 A | * | 4/2000 | Hemmerlein et al. | 123/447 |
| 6,553,972 B1 | * | 4/2003 | Yamamoto et al. | 123/497 |

FOREIGN PATENT DOCUMENTS

| | | |
|---|---|---|
| DE | 36 10 064 A1 | 10/1986 |
| DE | 43 12 952 A1 | 10/1994 |
| JP | 2-31566 Y2 | 8/1990 |
| JP | 6-14069 Y2 | 4/1994 |

* cited by examiner

*Primary Examiner*—Carl S. Miller

(57) ABSTRACT

To provide a fuel pump control device allowing a fuel pump having a small capacity to feed a sufficient amount of fuel to an internal combustion engine. During running of a vehicle at a low speed (for example, less than 2,0 km/hr), pulsed drive voltages are intermittently supplied to a fuel pump in accordance with each opening/closing of a thyristor on the basis of ignition pulses of the engine. In this way, the fuel pump repeats discharge operation at a relatively long cycle in synchronization with the pulsed drive voltages. During running of the vehicle at a high speed, a drive voltage is continuously supplied (that is, a DC voltage is supplied) from a power supply line to the fuel pump, whereby the fuel pump repeats discharge operation at a cycle with a short self-excitation state.

9 Claims, 3 Drawing Sheets

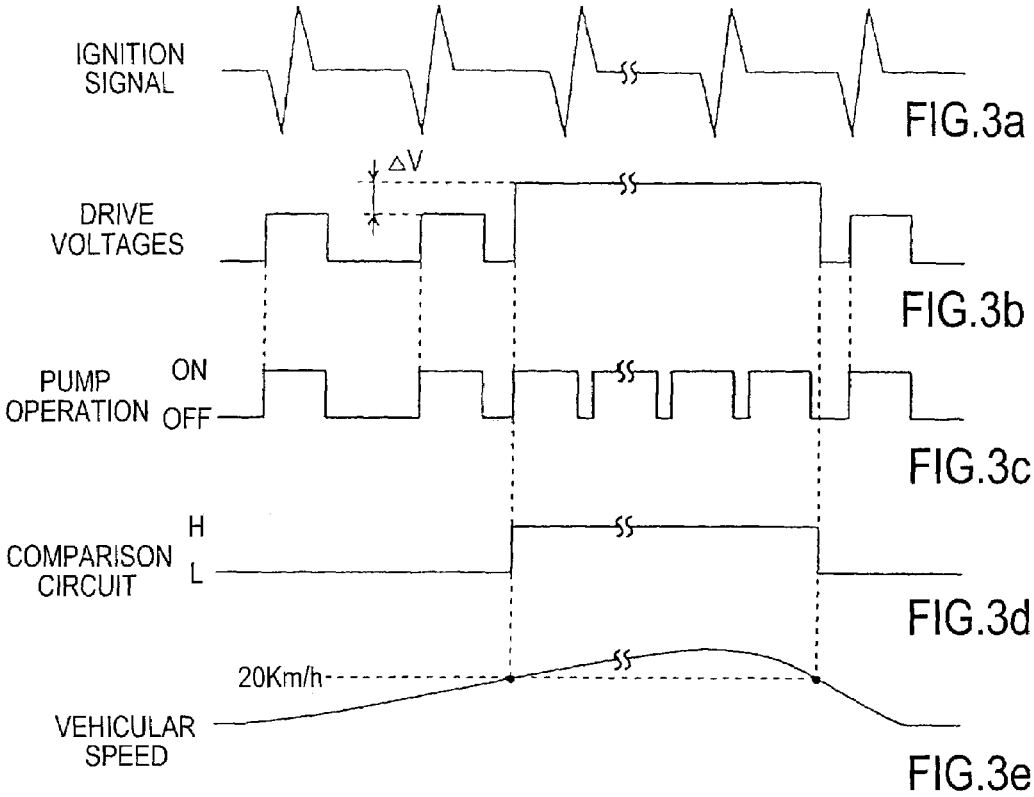
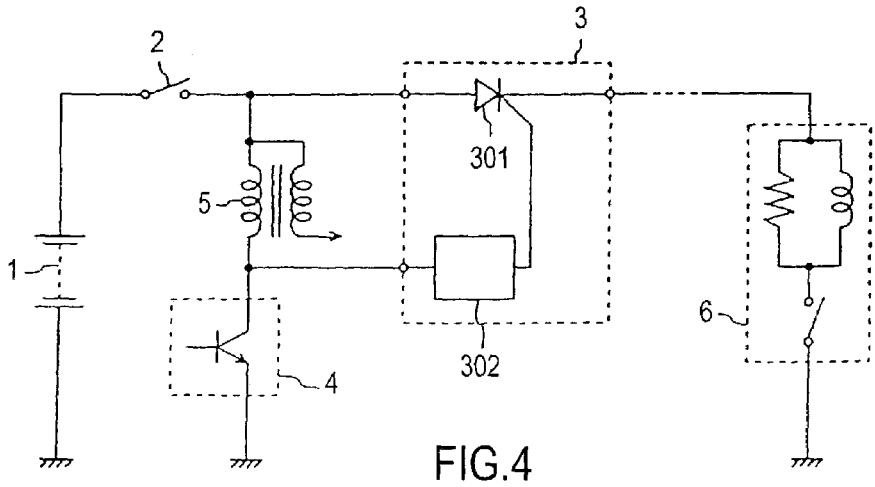
FIG.4

FUEL PUMP CONTROL DEVICE

This application is a divisional of application Ser. No. 09/456,477, filed on Dec. 7, 1999 now U.S. Pat. No. 6,553,972, the entire contents of which are hereby incorporated by reference and for which priority is claimed under 35 U.S.C. §120; and this application claims priority of Application No. HEI-10-346358 filed in Japan on Dec. 7, 1998 under 35 U.S.C. §119.

BACKGROUND OF THE INVENTION

1. Field of the Invention

The present invention relates to a fuel pump control device, and more particularly to a fuel pump control device allowing a fuel pump having a small capacity to feed a sufficient amount of fuel to an internal combustion engine.

2. Description of Background Art

As described in Japanese Utility Model Publication Nos. Hei 2-31566 and Hei 6-14069, control devices for controlling an electrically-operated fuel pump for feeding fuel to an internal combustion engine have been configured such that a relay means is connected between the fuel pump and a battery, wherein the fuel pump is intermittently operated by opening/closing the relay means on the basis of an ignition signal for an engine.

FIG. 4 is a block diagram showing an essential portion of the above-described related art fuel pump control device. Referring to FIG. 4, a fuel pump control device 3 includes a thyristor (SCR) 301 as a relay means and an ignition circuit 302. The thyristor 301 is connected, together with an ignition switch 2, in series between a fuel pump 6 and a battery 1. An ignition coil 5 and an ignitor 4 connected in series to each other are connected in parallel to the battery 1 via the ignition switch 2. An ignition pulse is supplied from the ignition coil 5 to the ignition circuit 302. Accordingly, the thyristor 301 is opened/closed one time for each ignition of the engine, to thereby intermittently drive the fuel pump.

The thyristor 301 as the relay means, which has no mechanical contact, is excellent in durability; however, it has a large voltage drop $\Delta V$ at a PN junction. As a result, a drive voltage applied to the fuel pump 6 is lower than a battery voltage by the voltage drop $\Delta V$. On the other hand, as shown in FIG. 5, since the feeding ability of the fuel pump is, generally, largely dependent on a drive voltage. Accordingly, if the drive voltage is reduced as described above, the fuel pump cannot feed a sufficient amount of fuel. For this reason, in the case of adopting the thyristor as the relay means, there occurs a problem that it is required to use a fuel pump having a large capacity, that is, a large-sized, expensive fuel pump for feeding a sufficient amount of fuel even if the drive voltage applied to the fuel pump is lower than the battery voltage.

SUMMARY AND OBJECTS OF THE INVENTION

An object of the present invention is to solve the problem of the above-described related art fuel pump control device and to provide a fuel pump control device allowing a fuel pump having a small capacity to feed a sufficient amount of fuel to an internal combustion engine.

To achieve the above object, the present invention provides the following configurations:

(1) a fuel pump control device for intermittently supplying a drive signal, to an electrically-operated fuel pump for feeding fuel to an internal combustion engine, in synchronization with an ignition signal for the internal combustion engine, characterized in that a drive signal is continuously supplied to the fuel pump in accordance with a running state of a vehicle; and (2) a fuel pump control device for controlling an electrically-operated fuel pump for supplying fuel to an internal combustion engine, characterized in that the control device comprises: a vehicle running state deciding means for generating a vehicle running state signal representative of a running state of a vehicle; a comparing means for comparing the vehicle running state signal with a specific value; and a controlling means for controlling opening/closing of the connection between the fuel pump and a power supply line in accordance with the comparison result obtained by the comparing means.

According to the above-described first feature, a drive signal is continuously supplied to the fuel pump under a specific, vehicle running state, whereby the fuel pump repeats the discharge operation. Accordingly, it is possible to increase the discharged amount per unit time without enlarging the fuel pump.

According to the above-described feature (2), since the fuel pump is directly connected to the power supply line under a specific vehicle running state, the fuel pump repeats the discharge operation. Accordingly, it is possible to increase the discharged amount per unit time without enlarging the fuel pump.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3*a* is a timing chart of the ignition signal showing the operation of the fuel pump control device shown in FIG. 1;

FIG. 3*b* is a timing chart of the drive pressure showing the operation of the fuel pump control device shown in FIG. 1;

FIG. 3*c* is a timing chart of the pump operation showing the operation of the fuel pump control device shown in FIG. 11

FIG. 3*d* is a timing chart of the comparison circuit showing the operation of the fuel pump control device shown in FIG. 1;

FIG. 3*e* is a timing chart of the vehicular speed showing the operation of the fuel pump control device shown in FIG. 1;

FIG. 4 is a block diagram of a related art fuel pump control device; and

DETAILED DESCRIPTION OF THE PREFERRED EMBODIMENTS

Figure 1:
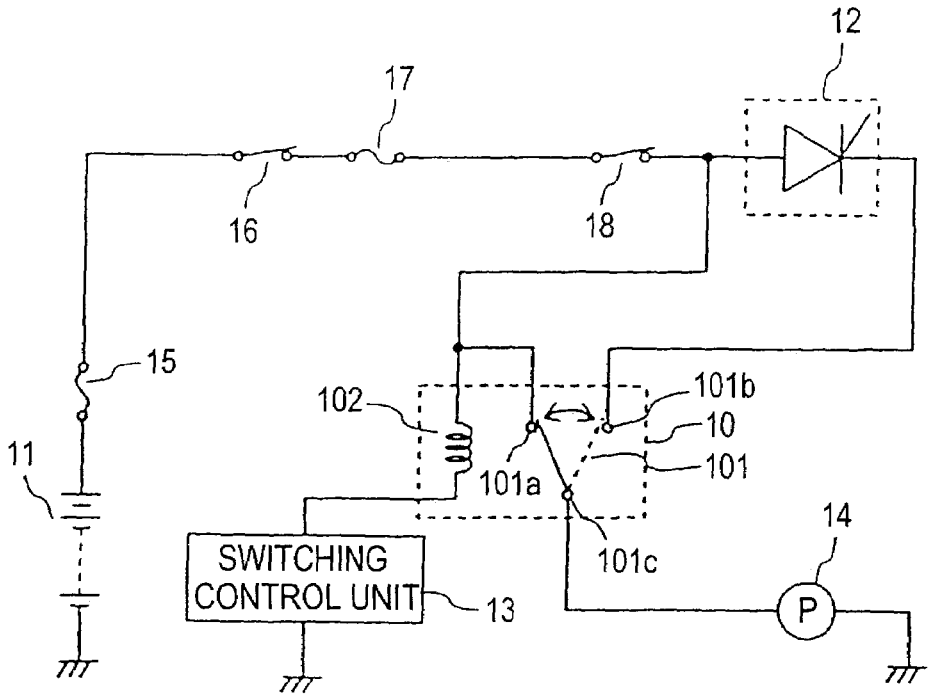
FIG. 1 is a block diagram showing a fuel pump control unit according to one embodiment of the present invention.

Hereinafter, the present invention will be described in detail with reference to the drawings. FIG. 1 is a block diagram showing the configuration of an essential portion of a fuel pump control device according to one embodiment of the present invention, and FIGS. 3*a* to 3*e* are timing charts showing the operational timing of the control device.

Referring to FIG. 1, fuses, 15 and 17, a main switch 16, and a kill switch 18 are connected in series to a power supply line between a battery 11 and the input terminal of a thyristor 12. A drive voltage is selectively applied from the input terminal or output terminal of the thyristor 12 to a fuel pump 14 via a switching device 10. When a pulsed drive voltage is applied to the fuel pump 14, the fuel pump 14 performs a discharge operation in synchronization with the cycle of the pulse of the applied drive voltage, and if a DC voltage is applied to the fuel pump 14, the fuel pump 14 repeats the discharge operation at a cycle with a short self-excitation state. An ignition signal of an engine is inputted to a control terminal of the thyristor 12.

The switching device 10 includes a power supply path switching relay 101 and its drive coil 102. A first movable contact 101*a* of the switching relay 101 is connected to a power supply line at a position between the kill switch 18 and the thyristor 12, and a second movable contact 101*b* of the switching relay 101 is connected to the output terminal of the thyristor 12. A fixed contact 101*c* of the switching relay 101 is connected to the fuel pump 14.

The drive coil 102 of the switching relay 101 has one end connected to the power supply line at a position offset on the battery 11 side from the thyristor 12, and has the other end connected to a switching control unit 13. The fixed contact 101*c* of the switching relay 101 is connected to the second movable contact 101*b* side if the drive coil 102 is in a non-excitation state, and is connected to the first movable contact 101*a* side if the drive coil 102 is in an excitation state.

Figure 2:
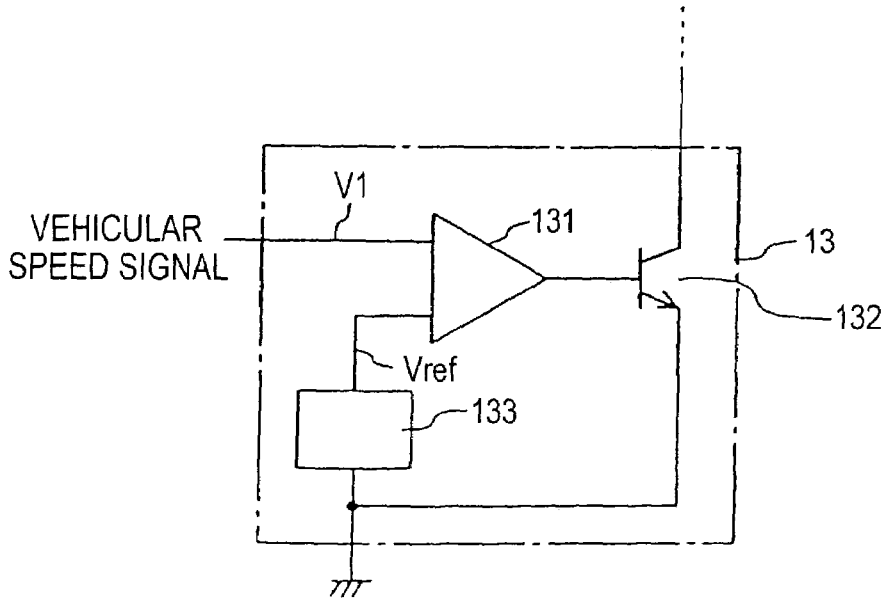
FIG. 2 is a block diagram showing one example of a switching control circuit shown in FIG. 1.
Figure 5:
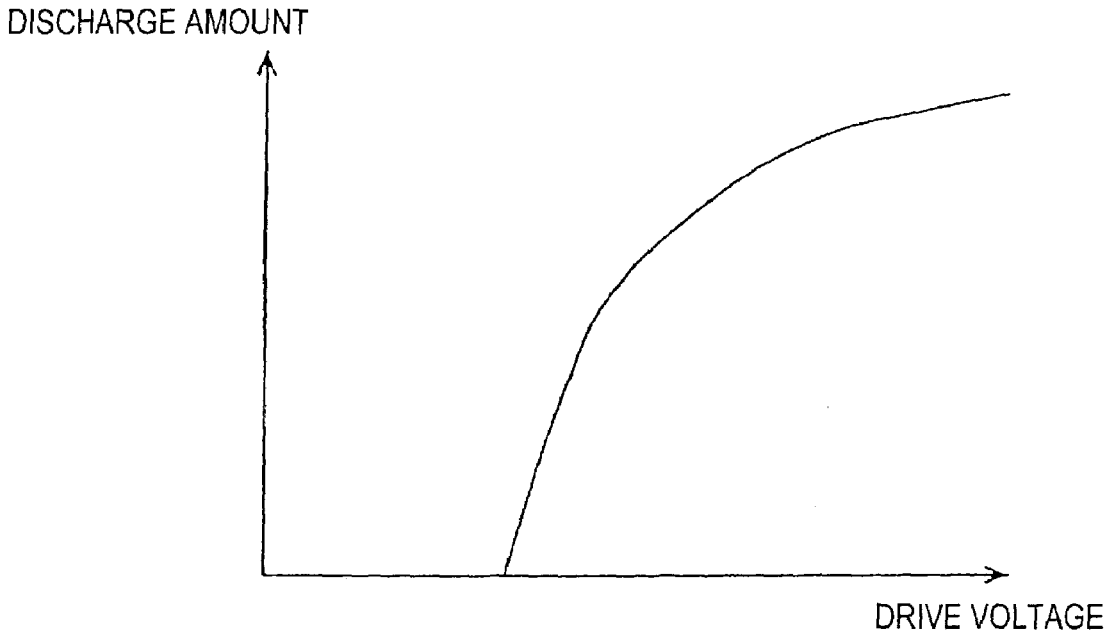
FIG. 5 is a graph showing a relationship between the drive voltage applied to a fuel pump-and the discharge amount discharged from the fuel pump.

FIG. 2 is a block diagram showing one embodiment of the switching control unit 13, which includes a comparison circuit 131, a reference vehicular speed signal generating circuit 133, and a switching transistor 132.

The other end of the drive coil 102 is connected to a collector terminal of the switching transistor 132. A vehicular speed signal V1, typically a drive signal from a speed meter, is inputted as a signal representative of a vehicle running state in one input terminal of the comparison circuit 131. A reference vehicular speed signal Vref is supplied from the reference vehicular speed generating circuit 133 to the other input terminal of the comparison circuit 131. In this embodiment, the reference vehicular speed signal Vref is set at the same value as the vehicular speed signal V1 at 20 km/hr.

With this configuration, during running of the vehicle at a speed less than 20 km/hr, since the vehicular speed signal V1 is less than the reference vehicular speed signal Vref, the output from the comparison circuit 131 keeps an "L" level as shown in FIG. 3*d*. As a result, the switching transistor 132 is cut off and thereby the drive coil 102 of the switching relay 101 is not excited, so that the movable contact 101*b* side of the switching relay 101 is selected. Accordingly, pulsed drive voltages are intermittently supplied to the fuel pump 14 in accordance with each opening/closing of the thyristor 12 on the basis of ignition pulses of the engine. FIGS. 3*a* to 3*e* are timing charts showing the operational timing of the control device. In this way, the fuel pump 14 repeats discharge operation at a relatively long cycle in synchronization with the pulsed drive voltages.

On the contrary, if the vehicular speed becomes more than 20 km/hr, the vehicular speed signal V1 exceeds the reference vehicular speed signal Vref, so that the output from the comparison circuit 131 becomes an "H" level. As a result, the switching transistor 132 is conducted to excite the drive coil 102 of the switching relay 101, so that the movable contact 101*a* side of the switching relay 101 is selected. Accordingly, a drive voltage is continuously supplied (that is, a DC voltage is supplied) from the power supply line to the fuel pump 14, whereby the fuel pump 14 repeats the discharge operation at a cycle with a short self-excitation state.

Further, at the vehicular speed of 20 km/hr or more, since the drive voltage is directly supplied from the power supply line to the fuel pump 14 not by way of the thyristor 12, the drive voltage becomes larger than the drive voltage upon intermittent operation at the vehicular speed less than 20 km/hr by the voltage drop $\Delta V$ at the thyristor 12.

Accordingly, in this embodiment, when the running speed of the vehicle is increased, a drive signal is continuously supplied to the fuel pump 14, so that the fuel pump 14 repeats the discharge operation in the self-excitation state. As a result, it is possible to increase the discharge amount per unit time without enlarging the fuel pump.

According to this embodiment, the power supply to the fuel pump 14 can be perfectly cut off by opening the kill switch 18 irrespective of intermittent or continuous supply of power to the fuel pump.

In this embodiment, since the switching relay 101 is not of a type opened/closed in synchronization with ignition pulses of the engine, it does not require high speed operation, a large capacity, or a strict durability, and therefore, such a switching relay 101 can be configured as a mechanical relay or an inexpensive switching transistor. As a result, the increased cost by additionally providing the switching device 10 can be made sufficiently lower than the increased cost by increasing the capacity of the fuel pump.

In this embodiment, the power supply path communicated to the fuel pump 14 is switched to increase the supplied amount of fuel when the vehicular speed exceeds 20 km/hr; however, the above switching may be performed when the vehicular speed becomes a specific high speed such as 60 km/hr to-80 km/hr.

The signal representative of the vehicular speed is not necessarily limited to the drive signal from the speed meter described in the embodiment but may be a control signal representative of the vehicular speed in a vehicle controlling computer (ECU) or a signal representing the rotational number of an output shaft of a transmission.

The signal representing the vehicle running state is not necessarily limited to the above-described signal representative of the vehicular speed but may be another state signal closely associated with the fuel consumption in the engine, such as a signal representative of the engine speed or a signal representative of the throttle opening degree.

The present invention exhibits the following effects:

(1) According to the present invention, a drive signal is continuously supplied to the fuel pump under a specific vehicle running state, whereby the fuel pump repeats the discharge operation. Accordingly, it is possible to increase the discharged amount per unit time without enlarging the fuel pump.

(2) According to the present invention, since the fuel pump is directly connected to the power supply line under a specific vehicle running state, the fuel pump repeats the discharge operation. Accordingly, it is possible to increase the discharged amount per unit time without enlarging the fuel pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel pump control device for intermittently supplying fuel comprising:

a drive signal for an electrically-operated fuel pump for feeding fuel to an internal combustion engine of a vehicle, in synchronization with an ignition signal for said internal combustion engine; and a comparing means for comparing a value of a signal determined by a sensed vehicular speed with a specific value generated by a reference vehicular speed signal generating circuit, said drive signal having a first positive DC voltage which is continuously supplied to said fuel pump when the sensed vehicular speed is higher than the reference vehicular speed, and having a pulsed voltage which is intermittently supplied to the fuel pump when the vehicular speed is lower than the reference vehicular speed.

2. A fuel pump control device for controlling an electrically-operated fuel pump for supplying fuel to an internal combustion engine, said control device comprising:

a vehicle operating state deciding means for generating a vehicle operating state signal representative of a vehicle speed of a vehicle;

a comparing means for comparing said vehicle speed with a specific value; and a controlling means for controlling opening/closing of a connection between said fuel pump and a power supply line providing a continuous positive DC voltage in accordance with the comparison result obtained by said comparing means, wherein said controlling means includes a thyristor operatively connected to said fuel pump for selectively supplying power thereto, and wherein said comparing means includes a reference vehicular speed signal generating circuit operatively connected to a comparison circuit and a switching transistor for selectively actuating a drive coil.

3. The fuel pump control device for controlling an electrically-operated fuel pump for supplying fuel to an internal combustion engine according to claim 2, wherein said controlling means further includes said drive coil and a switching relay for selectively connecting said drive coil to said fuel pump.

4. The fuel pump control device for intermittently supplying fuel according to claim 1, said drive signal having a second positive DC voltage and being intermittently supplied to said fuel pump when the vehicular speed is lower than the reference vehicular speed.

5. The fuel pump control device for intermittently supplying fuel according to claim 4, wherein the first positive DC voltage is higher than the second positive DC voltage.

6. The fuel pump control device for controlling an electrically-operated fuel pump for supplying fuel to an internal combustion engine according to claim 2, further comprising:

a drive signal for an electrically-operated fuel pump for feeding fuel to an internal combustion engine of a vehicle, in synchronization with an ignition signal for said internal combustion engine, said drive signal having a first positive DC voltage and being continuously supplied to said fuel pump in accordance with the sensed vehicular speed.

7. The fuel pump control device for controlling an electrically-operated fuel pump for supplying fuel to an internal combustion engine according to claim 6, said drive signal having a second positive DC voltage and being intermittently supplied to said fuel pump when the vehicular speed is lower than the reference vehicular speed.

8. The fuel pump control device for controlling an electrically-operated fuel pump for supplying fuel to an internal combustion engine according to claim 7, wherein the first positive DC voltage is higher than the second positive DC voltage.

9. The fuel pump control device for intermittently supplying fuel according to claim 1, wherein said comparing means includes a reference vehicular speed signal generating circuit operatively connected to a comparison circuit and a switching transistor for selectively actuating a drive coil.

* * * * *